US006427315B1

(12) United States Patent
Kitagawa et al.

(10) Patent No.: US 6,427,315 B1
(45) Date of Patent: Aug. 6, 2002

(54) COIL COMPONENT AND MANUFACTURING METHOD FOR THE SAME

(75) Inventors: Toshio Kitagawa, Takefu; Yukio Hata, Fukui, both of (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/333,907

(22) Filed: Jun. 16, 1999

Related U.S. Application Data

(62) Division of application No. 08/916,283, filed on Aug. 22, 1997, now Pat. No. 6,100,782.

(30) Foreign Application Priority Data

Aug. 23, 1996 (JP) ..... 8-222677

(51) Int. Cl.[7] ..... H01F 7/06
(52) U.S. Cl. ..... 29/602.1; 29/605; 336/192
(58) Field of Search ..... 29/605, 602.1, 29/860; 336/192

(56) References Cited

U.S. PATENT DOCUMENTS 3,781,981 A * 1/1974 Miura et al. ..... 29/597
4,439,255 A * 3/1984 Imai et al. ..... 29/860 X
4,902,867 A 2/1990 Haramaki et al.
4,950,866 A 8/1990 Kojima et al.
5,153,549 A 10/1992 Morinaga
5,457,872 A 10/1995 Sakata et al.
5,497,936 A 3/1996 Vojta et al.

FOREIGN PATENT DOCUMENTS

JP 62-68209 4/1987
JP 2-156606 6/1990

* cited by examiner

*Primary Examiner*—Carl J. Arbes
(74) *Attorney, Agent, or Firm*—Burns, Doane, Swecker & Mathis, LLP

(57) ABSTRACT

A coil component and a manufacturing method for producing the same permit a wire terminal to be bonded to an electrode with high reliability by implementing thermal compression bonding using a heater chip. The coil component comprises a bobbin around which a wire is wound, the wire having a solder layer on the outer peripheral surface of a core conductor and an insulating layer formed on the outer peripheral surface of the solder layer. The wire terminal is secured to the electrode provided on the bobbin by thermal compression bonding. A heated heater chip is applied to the terminal to break the insulating layer and to melt the solder layer at substantially the same time. Then, pressure is applied to the heater chip to provide intermetallic bonding between the core conductor and the electrode. Melted solder solidifies and covers the area around the core conductor, thereby securely bonding the wire terminal to the electrode.

6 Claims, 2 Drawing Sheets

COIL COMPONENT AND MANUFACTURING METHOD FOR THE SAME

This application is a divisional of Application No. 08/916,283, filed Aug. 22, 1997, now U.S. Pat. No. 6,100, 782.

This application corresponds to Japanese Patent Application No. 8-222677 filed on Aug. 23, 1996, which is hereby incorporated by reference in its entirety.

BACKGROUND OF THE INVENTION

1. Field of the Invention

The present invention relates to a coil component such as an inductor, choke coil, etc. and a manufacturing method for producing the same.

2. Description of Related Art

Hitherto, in an inductor, choke coil, or other coil component, copper wire coated with an insulating layer has been used as the wire wound around the component's bobbin. A terminal has normally been secured to an electrode of the bobbin by thermal compression bonding which employs a heater chip. However, simply securing the terminal of the copper wire onto the electrode by thermal compression bonding can cause a problem in that the reliability of the thermal compression bonding heavily depends on the pressurizing condition of the heater chip, the destroyed state of the insulating layer (i.e., whether the insulating layer has been sufficiently removed), the variations in the copper wire material, contamination of the heater chip, the condition of an electrode surface, etc.

Hence, in order to reinforce the thermal compression bonding and improve the reliability of the bond, a conductive adhesive agent has been applied or soldering has been performed following the thermal compression bonding process. This, however, adds to the number of steps in the manufacturing process and also adds to the cost because of the need for installing additional equipment for the extra step following the thermal compression bonding.

SUMMARY OF THE INVENTION

Accordingly, it is an object of the present invention to provide a coil component and a manufacturing method for producing the same which permit a wire terminal to be secured to an electrode of a bobbin with high reliability simply by conducting thermal compression bonding with a heater chip.

To this end, according to exemplary embodiments of the present invention, there is provided a coil component which employs, as a winding, a wire having a solder layer formed on the outer peripheral surface of a core conductor and an insulating layer formed on the outer peripheral surface of the solder layer. A terminal of the wire is fixed to an electrode provided on the bobbin by thermal compression bonding. More specifically, the terminal of the wire is first positioned on the electrode, and then a heated heater chip is brought into contact with the wire terminal to break the insulating layer and melt the solder layer at the same time. After that, the heater chip is pressurized against the terminal to provide intermetallic bonding between the core conductor and the electrode.

The core conductor is deformed when it is pressed with the heater chip and secured to the electrode by intermetallic bonding, and the affected area is further surrounded by melted solder. Therefore, when the solder solidifies, the fixation of the core conductor is reinforced with resultant improved reliability of the bond between the terminal and the electrode.

BRIEF DESCRIPTION OF THE DRAWINGS

The foregoing, and other, objects, features and advantages of the present invention will be more readily understood upon reading the following detailed description in conjunction with the drawings in which.

DESCRIPTION OF THE PREFERRED EMBODIMENTS

An embodiment of a coil component and a manufacturing method for the same in accordance with the present invention will now be described with reference to the accompanying drawings.

Figure 1:
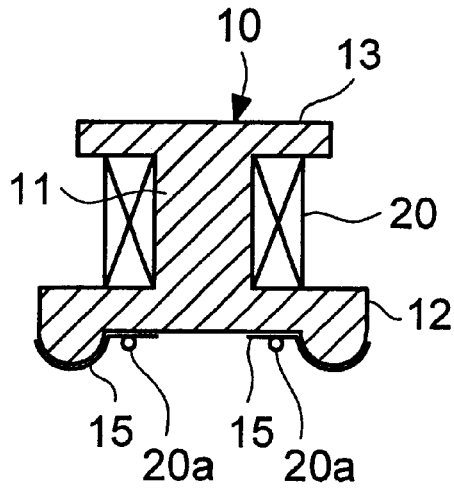
FIG. 1 is a sectional view illustrating a coil component in one exemplary embodiment according to the present invention.
Figure 2:
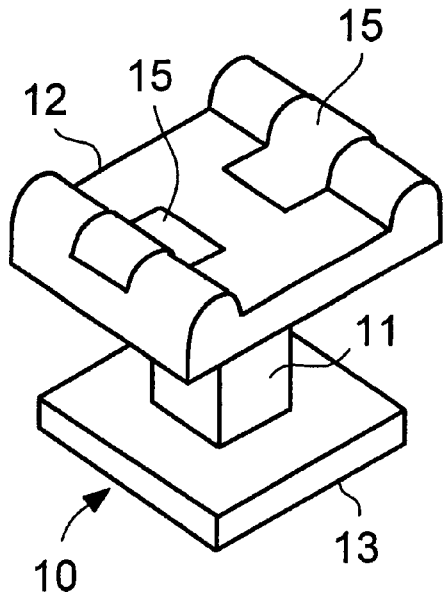
FIG. 2 is a perspective view of an exemplary bobbin shown in FIG. 1.

In FIG. 1, an exemplary coil component is comprised of a bobbin 10 and a wound wire 20. The bobbin 10 is made of, for example, ferrite, dielectric ceramic, or like material, which is formed into one piece. The bobbin 10 is comprised of a section 11 around which the wire 20 is wound, a lower flange 12, and an upper flange 13. The lower flange 12 is provided with a pair of electrodes 15 as shown in both FIGS. 1 and 2. Terminals 20*a* of the wire 20 are secured to the electrodes 15 by the thermal compression bonding process set forth below.

Figure 3:
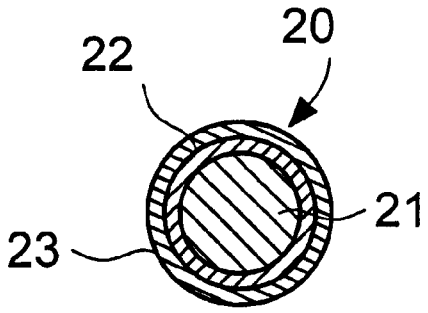
FIG. 3 is a sectional view of an exemplary wire shown in FIG. 1.

In the exemplary wire 20, the outer peripheral surface of a core conductor 21 made of copper (or other conductive material) is covered by a solder layer 22, and the outer peripheral surface of the solder layer 22 is covered by an insulating layer 23 as shown in FIG. 3. The solder layer 22 is formed, for example, to a thickness of approximately 1/10 to 1/50 of the diameter of the core conductor 21 by a solder plating process or other process. The component ratio of tin (Sn) to lead (Pb) of the solder is approximately 5 to 90 against 95 to 10 according to exemplary embodiments. As those skilled in the art will appreciate, the solder can be composed of additional or different materials. The insulating layer 23 is formed by applying and drying a resin material such as polyurethane and polyvinyl butyral, or other insulating material.

Figure 4:
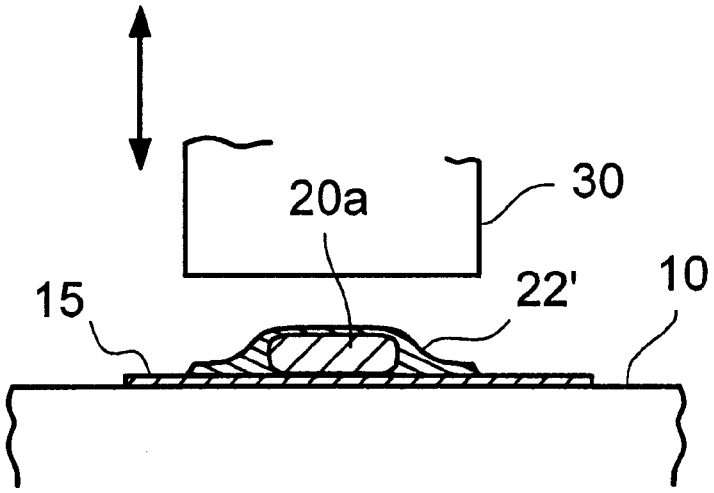
FIG. 4 is a schematic representation of the thermal compression bonding process of a coil terminal according to exemplary aspects of the present invention.

The terminals 20*a* of the wire 20 are secured to the electrodes 15 positioned in the recessed portion of the lower flange 12 by thermal compression bonding and by using a heater chip 30 shown in FIG. 4. More specifically, the heater chip 30 is first heated to approximately 400 to 600 degrees Celsius (or other suitable temperature), and then applied to the wire terminal 20*a* set on the electrode 15. The heat of the heater chip 30 thermally decomposes the insulating layer 23 and also melts the solder layer 22. Further, a pressure of approximately 0.5 to 3.0 kgf/cm$^2$ is applied to the heater chip 30 so as to deform the core conductor 21 and push the solder, which has been melted between the core conductor 21 and the electrode 15, out around the core conductor 21. Thus, the core conductor 21 and the electrode 15 are brought in direct contact and bonded by intermetallic bonding.

The pressuring step can be performed immediately when the heater chip 30 is applied to the terminal 20*a*, or some time thereafter (e.g. after the insulating layer 23 has been degraded and the solder layer 22 has been melted). In one exemplary embodiment, the heater chip 30 is applied and pressurized for approximately 0.5 to 5 seconds and then immediately removed. When the temperature around the terminal 20*a* decreases, the adhesion of the terminal 20*a* onto the electrode 15 is reinforced by the adhering force of solidified solder 22' in conjunction with the intermetallic bonding.

The coil components and the manufacturing method for producing the same in accordance with the present invention are not limited to the exemplary embodiment described above. It will be apparent to those skilled in the art that the structure and techniques disclosed herein can be applied to a wide variety of electrical components. Further, the structure and techniques disclosed herein can be applied to a wide variety of manufacturing processes which employ steps and/or operating parameters which differ from the exemplary steps and parameters disclosed above.

In summary, according to the present invention, a wire includes a solder layer which is formed on the outer peripheral surface of the core conductor of the wire, and the wire includes an insulating layer which is formed on the outer peripheral surface of the solder layer. The terminals of the wire are secured to electrodes provided on a bobbin by thermal compression bonding. Therefore, the melted solder solidifies around the terminals to provide the reinforcing effect of soldering in addition to providing intermetallic bonding adhesion between the core conductor and the electrodes, thus permitting higher bonding reliability. Furthermore, the conventional post-processing of soldering or applying an adhesive agent and the coating process for protecting the terminal portions are no longer necessary. Moreover, the heat generated from the melted solder is added to the heat from the heater chip to degrade the insulating layer, so that the thermal decomposition of the insulating layer can be accomplished reliably and securely.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A manufacturing method for a coil component comprising a wire wound around a bobbin, said wire having a core conductor provided with a solder layer formed on the outer peripheral surface thereof, and an insulating layer formed on the outer peripheral surface of said solder layer, said manufacturing method comprising the steps of:

positioning a terminal of said wire on an electrode provided on said bobbin and applying a heated heater chip to the terminal of said wire so as to degrade said insulating layer and to m elt said solder layer at substantially the same time;

pressurizing said heater chip against said terminal to provide intermetallic bonding adhesion between said core conductor and said electrode; and removing said heater chip from said terminal.

2. The manufacturing method of claim 1, wherein said solder layer is formed to a thickness of approximately 1/10 to 1/50 of the diameter of the core conductor.

3. The manufacturing method of claim 1, wherein said step of pressurizing comprises pressurizing said heater chip against terminal at a force of approximately 0.5 to 3.0 $kgf/cm^2$.

4. The manufacturing method of claim 1, wherein said step of pressurizing comprises pressurizing said heater chip against said terminal for approximately 0.5 to 5 seconds.

5. The manufacturing method of claim 1, wherein said step of applying and said step of pressurizing are concurrently performed.

6. The manufacturing method of claim 1, wherein said step of pressurizing follows said step of applying.

* * * * *